US008697195B2

(12) United States Patent
Bucci et al.

(10) Patent No.: US 8,697,195 B2
(45) Date of Patent: Apr. 15, 2014

(54) METHOD FOR FORMING A PROTECTIVE COATING WITH ENHANCED ADHESION BETWEEN LAYERS

(75) Inventors: David Bucci, Simpsonville, SC (US); Daniel A. Nowak, Greeenville, SC (US); Paul S. Dimascio, Greer, SC (US)

(73) Assignee: General Electric Company, Schenectady, NY (US)

( * ) Notice: Subject to any disclaimer, the term of this patent is extended or adjusted under 35 U.S.C. 154(b) by 1678 days.

(21) Appl. No.: 11/307,266

(22) Filed: Jan. 30, 2006

(65) Prior Publication Data

US 2007/0178247 A1 Aug. 2, 2007

(51) Int. Cl.

| | |
|---|---|
| ***B05D 3/04*** | (2006.01) |
| ***C23C 14/02*** | (2006.01) |
| ***H05H 1/00*** | (2006.01) |
| ***H05H 1/32*** | (2006.01) |

(52) U.S. Cl.
USPC ..... 427/534; 427/533; 427/540; 427/535; 427/307

(58) Field of Classification Search
USPC ..... 427/533, 299, 307, 532, 454, 534, 535, 427/540; 216/63, 67, 68, 71
See application file for complete search history.

(56) References Cited

U.S. PATENT DOCUMENTS

| | | | | |
|---|---|---|---|---|
| 4,633,054 | A * | 12/1986 | Patrick et al. | 219/118 |
| 5,462,609 | A | 10/1995 | Patrick et al. | 148/241 |
| 5,466,905 | A | 11/1995 | Flowers et al. | 219/121 |
| 5,512,318 | A | 4/1996 | Raghavan et al. | 427/230 |
| 5,770,273 | A * | 6/1998 | Offer et al. | 427/455 |
| 5,817,371 | A | 10/1998 | Gupta et al. | |
| 5,830,586 | A * | 11/1998 | Gray et al. | 428/621 |
| 6,042,898 | A * | 3/2000 | Burns et al. | 427/534 |
| 6,242,050 | B1 * | 6/2001 | Ritter et al. | 427/454 |
| 6,482,469 | B1 | 11/2002 | Spitsberg et al. | |
| 2005/0035085 | A1 * | 2/2005 | Stowell et al. | 216/76 |

FOREIGN PATENT DOCUMENTS

| | | |
|---|---|---|
| EP | 1281788 A | 2/2003 |
| EP | 1788108 A | 5/2007 |

* cited by examiner

*Primary Examiner* — Michael Wieczorek
(74) *Attorney, Agent, or Firm* — Sutherland Asbill & Brennan LLP

(57) ABSTRACT

A method for forming a protective coating on a substrate comprising, applying a bond coating to the substrate, the bond coating having a first surface roughness, ionizing an inert gas which flows into the surface of the bond coating so as to impart a second surface roughness to the bond coating greater than the first surface roughness, wherein the inert gas is ionized and caused to flow into the surface of the bond coating by a reverse polarity current supplied to an electrode which removes at least one electron from the inert gas, and applying a top coating to the bond coating. Additionally, a method for preparing a surface to receive and adhere to a coating comprising roughening the surface to create a micro-roughening network on the surface. In addition, a method of improving strain tolerance and cyclic spallation life of a protective coating.

17 Claims, 1 Drawing Sheet

METHOD FOR FORMING A PROTECTIVE COATING WITH ENHANCED ADHESION BETWEEN LAYERS

TECHNICAL FIELD

This invention relates to protective coatings and methods for forming the same.

BACKGROUND OF THE INVENTION

Coatings are often applied to metallic surfaces to protect against wear, erosion, corrosion, oxidation or to lower surface temperatures. Coatings, such as oxidation-corrosion protection coatings for a metal, function by diffusing protective oxide forming elements like aluminum and chrome to the surface that is exposed to harmful externalities. Thermal barrier coatings (TBCs) are made up of a bond coating on the substrate and a top coating on the bond coating. Examples of bond coatings include diffusion aluminide bond coatings. The top coating is typically zirconia based and may comprise yttria, magnesia, ceria, scandia or rare earth oxide partially stabilized zirconia.

Application of these protective high temperature oxidation coatings can be by thermal spray and diffusion techniques. The top coating may be applied air plasma spray (APS) or electron beam physical vapor deposition (EB-PVD). EB-PVD has been used successfully in commercial applications of ceramic top coatings to aluminide diffusion bond coatings to create TBCs that are strain tolerant and have good spallation life for high thermal cycle applications. Likewise, application of top coatings using APS has been found to create microstructures with vertical cracks that improve TBC cyclic spallation life. However, attempts to apply this air plasma spray, dense vertically cracked (DVC) top coating to aluminide bond coatings have been unsuccessful due to lack of adhesion to the smooth surface of the bond coatings. In cases where DVC top coatings have adhered to a bond coating, the spallation life of the TBCs have been inferior to TBCs with bond coatings having two to three times the surface roughness.

Accordingly, there is a need for a simple and economically desirable method for preparing a bond coating surface to receive and adhere to a top coating for TBCs with improved strain tolerance and cyclic spallation life.

SUMMARY OF THE INVENTION

This disclosure addresses the above described need in the art by providing a method for forming a protective coating on a substrate comprising, applying a bond coating having a first surface roughness, ionizing an inert gas which flows into the surface of the bond coating so as to impart a second surface roughness to the bond coating greater than the first surface roughness, and applying a top coating to the bond coating. The inert gas is ionized and caused to flow into the surface of the bond coating by a reverse polarity current supplied to an electrode which removes at least one electron from the inert gas. The positively charged ions of the inert gas are repelled by the positively charged electrode and flow into surface of the bonding agent, causing particulate fragments of the surface of the bond coating to break off. Therefore, the ions create microscopic craters in the surface of the bonding agent. Consequently, this roughening of the surface of the bond coating improves the adherence of the top coating to the bond coating.

Other objects, features, and advantages of this invention will be apparent from the following detailed description, drawing, and claims.

DETAILED DESCRIPTION OF EMBODIMENTS

As summarized above, this disclosure encompasses a method for forming a protective coating on a substrate, a method for preparing a surface to receive and adhere to a coating. In a particular embodiment, a method for improving the strain tolerance and the cyclic spallation life of a thermal barrier coating (TBC) is disclosed. Embodiments of this invention are described in detail below and illustrated in FIGS. 1A-C.

Figure 1A:
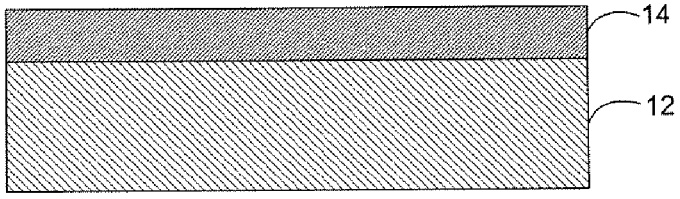
FIGS. 1 A-C show a schematic of a method for forming a thermal barrier coating on a substrate in accordance with an embodiment of the present invention.
Figure 1B:
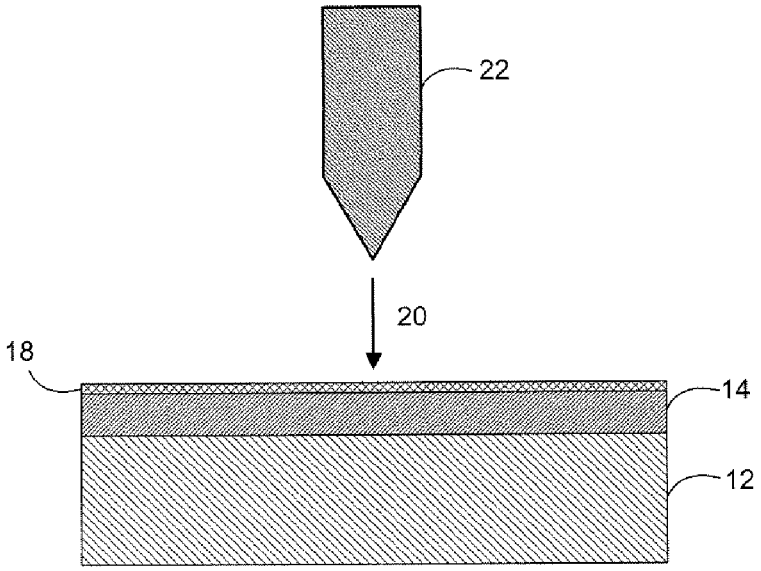
Figure 1C:
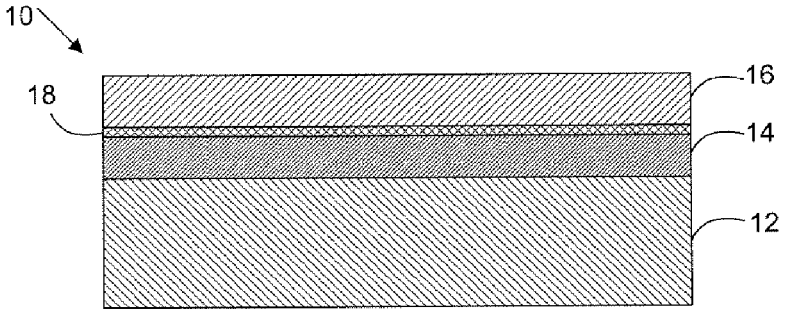

A thermal barrier coating (TBC) 10 formed on a substrate 12 by a method in accordance with an embodiment of this invention is illustrated in FIG. 1C. The TBC 10 comprises a bond coating 14 and a top coating 16. Although this embodiment illustrates a TBC, it should be understood that this invention is applicable to other types of coatings.

As show in FIG. 1A, the bond coating 14 is applied to the substrate 12. The substrate can comprise, but is not limited to, any nickel or cobalt based alloy. For example, the substrate may comprise a superalloy such as GTD-222 (51Ni19Co22Cr1.2Al2.3Ti.94Ta.8Nb2WCBZr). The bond coating 14 may be applied using various methods, including high velocity oxy-fuel spraying. Suitable materials for use as a bond coating 14 include, but are not limited to, aluminide diffusion bond coatings. These aluminide diffusion bond coatings may include modified or alloyed aluminides, chromium aluminide (CrAI), palladium aluminide (PdAI), platinum aluminide (PtAI), silicon modified aluminides, simple aluminide, and over aluminized MCrAIY, where M stands for Fe, Ni, Co, Si, Hf, Ta, Re, noble metals, or a mixture of Ni and Co or additional elements and combinations that well known to those skilled in the art. Additionally, aluminide diffusion bond coatings may be about 1 mil to about 4 mils thick.

The surface of the bond coating 14 as applied to the substrate 12 has a first roughness that is inherently smooth. For example, a bond coating 14 made of aluminide has a surface roughness of less than about 60 microinches Ra, where Ra is the arithmetic mean of displacement values as calculated to quantify the degree of roughness achieved. The inherent smoothness of the bond coating 14 results in poor adherence of a top coating 16, particularly air plasma spray (APS) top coatings. Consequently, the bond coating 14 is roughened to improve adherence of the top coating 16 to the bond coating.

As shown in FIG. 1B, a micro-roughening network 18 is created on the surface of the bond coating 14 by using an electrode 22 to ionize an inert gas and cause the ions 20 to flow into the bond coating surface. To ionize the inert gas, the electrode 22 is supplied a reverse polarity current (not shown). This reverse polarity current is a direct current set at a high frequency to create the ions 20 in the inert gas. The reverse polarity current is also set at an amperage between about 0 and about 10 amperes. A higher amperage setting results in a roughness greater than a roughness that would result from a lower amperage setting. Once the electrode 22 is supplied a reverse polarity current, it removes at least one electron from the inert gas that is supplied adjacent to the bond coating 14. The inert gas may be, but is not limited to argon. While argon may be used as the inert gas, it should be understood that any inert gas may be used, provided that it is may be ionized and used in roughening the bond coating 14 in accordance with the methods of the present invention. As a result of the removal of at least one electron, the inert gas is ionized to a positive charge and the positively charged electrode 22 repels the ions 20 toward the bond coating 14. These ions bombard the bond coating 14, causing particulate fragments to break off and microscopic craters to form. Thus, the ionized inert gas 20 imparts a second surface roughness to the bond coating 14 greater than the first surface roughness.

The second surface roughness of the bond coating 14 may be between about 75microinches Ra to about 750 microinches Ra. More particularly, the second surface roughness of the bond coating 14 may be between about 100 microinches Ra to about 600 microinches Ra. Still more particularly, the second surface roughness of the bond coating may be between about 150 microinches Ra to about 450 microinches Ra. This second surface roughness resulting from the creation of the micro-roughening network 18 on the bond coating 14 promotes adhesion and mechanical bonding of the top coating 16 to the bond coating.

The roughening of the bond coating 14 to create the micro-roughening network 18 may be manual or automated using a mechanical device such as a robot. In addition, the bond coating 14 may be roughened in multiple passes to impart the desired second surface roughness.

The ionizing of the inert gas may be accomplished by using a reverse transfer arc welding torch. The reverse transfer arc welding torch may be a gas tungsten welding torch, a plasma arc welding torch, or any arc welding torch with a plasma source. Although a reverse transfer arc welding torch may be used in the present invention to ionize the inert gas, it should be understood that an electric arc is not conducted from the electrode in the reverse transfer arc welding torch to the bond coating. The formation of an electric arc between the electrode 22 and the bond coating 14 may melt the bond coating or cause cracking in the bond coating. To prevent the formation of an electric arc, the electrode is positioned at least about three times further from the bond coating than the distance the electrode would be positioned for arc welding. For example, a gas tungsten welding torch is positioned about 0.5 inches to about 1 inch away from a surface to be welded. In contrast, a gas tungsten welding torch used in a method in accordance with the present invention is positioned about 1.5 inches to about 3 inches from the bond coating to prevent an electric arc from forming.

In addition, the ions 20 which roughen the surface of the bond coating 14 bombard the bond coating at a slow speed relative to the speed at which the electrons strike the electrode. Consequently, only small amounts of heat are carried to the bond coating 14. Conversely, the electrons strike the electrode 22 at a high velocity and carry a substantial amount of welding heat. This, the heat may be removed from the electrode by water-cooling, for example.

Once the micro-roughening network 18 is created on the bond coating 14, the top coating 16 may be applied to the bond coating as shown in FIG. 1C. Adhesion and mechanical bonding of the top coating 16 to the bond coating 14 is improved by the micro-roughening network 18. The top coating 16 may be applied by air plasma spray (APS), for example. APS is particularly suitable for application of a dense vertically cracked (DVC) top coating 16. This DVC top coating 16 has vertical cracks within the top coating that consequently improve the TBC strain tolerance and cyclic spallation life. Suitable materials for use as the top coating 16 include, but are not limited to, ceramic materials. These ceramic materials may comprise yttria, magnesia, ceria, scandia or rare earth oxide partially stabilized zirconia. For example, the top coat may comprise yttria stabilized zirconia in an amount of 8% by weight of the top coat. In addition, the top coating 16 may be about 10 mils to about 100 mils thick.

The methods of forming TBCs of this invention may be used in articles having a TBC. Examples of such articles include a gas turbine or a diesel engine. In addition, the embodiments of the TBC may be formed on nickel or cobalt based alloys.

The present invention is further illustrated below in an example which is not to be construed in any way as imposing limitations upon the scope of the invention. On the contrary, it is to be clearly understood that resort may be had to various other embodiments, modifications, and equivalents thereof which, after reading the description therein, may suggest themselves to those skilled in the art without departing from the scope of the invention and the appended claims.

EXAMPLE 1

An example of an embodiment of a method for forming a TBC is disclosed in this example. General techniques of forming a TBC are well known in the art and are disclosed, for example, in U.S. Pat. No. 5,830,586, the disclosure of which is expressly incorporated herein by reference in its entirety.

In this embodiment, the forming of the TBC comprises applying an aluminide diffusion bond coating to either a nickel or cobalt based superalloy substrate. This bond coating has a smooth surface which is not optimal for applying an air plasma sprayed top coat. Thus, inert gas argon is then ionized by a gas tungsten arc welding machine and used to roughen the surface of the bond coating. The electrode is positioned at a distance from the aluminide diffusion bond coating to insure that an electric arc does not form. The reverse polarity current then removes electrons from the argon and creates positively charged argon ions which are repelled by the positively charged electrode towards the aluminide diffusion bond coating. The gas tungsten arc welding machine is traversed at a rate of about 1 inch per minute to impart a surface roughness of 150 microinches Ra to about 450 microinches Ra onto the bond coating. A top coating is air plasma sprayed onto the micro-roughening network created on the bond coating. The air plasma spraying of the dense vertically cracked top coating improves strain tolerance and cyclic spallation life of the TBC.

It should be understood that the foregoing relates to particular embodiments of the present invention, and that numerous changes may be made therein without departing from the scope of the invention as defined from the following claims.

What is claimed is:

1. A method for forming a protective coating on a substrate comprising:

applying a bond coating to the substrate, the bond coating having a first surface roughness of less than about 60 microinches Ra;

ionizing an inert gas which flows into the surface of the bond coating so as to impart a second surface roughness to the bond coating of about 75 microinches Ra to about 750 microinches Ra, wherein the inert gas is ionized and caused to flow into the surface of the bond coating by a reverse polarity current supplied to an electrode which removes at least one electron from the inert gas, and wherein the electrode and the bond coating are devoid of an electric arc between each other; and applying a top coating to the bond coating.

2. The method of claim 1, wherein the protective coating comprises a thermal barrier coating.

3. The method as in claim 1, wherein the ionizing of the inert gas comprises ionizing the inert gas using a reverse transfer arc welding torch.

4. The method of claim 1, wherein the reverse polarity current is a direct current at an amperage between about 0 and about 10 amperes.

5. The method of claim 1, wherein ionizing of the inert gas which flows into the surface of the bond coating imparts a second surface roughness to the bond coating between about 100 microinches Ra to about 600 microinches Ra.

6. The method of claim 1, wherein the ionizing of the inert gas which flows into the surface of the bond coating imparts a second surface roughness to the bond coating between about 150 microinches Ra to about 450 microinches Ra.

7. The method as in claim 1, wherein the bond coating is an aluminide diffusion bond coating.

8. The method as in claim 7, wherein the aluminide diffusion bond coating comprises a bond coating material selected from the group consisting of modified or alloyed aluminides, CrAl, PdAl, PtAl, simple aluminide, silicon modified aluminides, and over aluminized MCrAlY.

9. The method as in claim 1, wherein the applying of the top coating comprises air plasma spray.

10. The method as in claim 1, wherein the top coating comprises a ceramic material.

11. The method as in claim 10, wherein the ceramic material is selected from the group consisting of yttria, magnesia, ceria, scandia, and rare earth oxide partially stabilized zirconia.

12. The method of claim 1, wherein the top coating is a dense vertically cracked coating.

13. A method for preparing a surface to receive and adhere to a coating comprising:

providing the surface with a first surface roughness of less than about 60 microinches Ra;

roughening the surface to create a micro-roughening network, wherein the micro-roughening network has a second surface roughness of about 75 microinches Ra to about 750 microinches Ra, by ionizing an inert gas which flows into the surface, wherein the inert gas is ionized and caused to flow into the surface by a reverse polarity current supplied to an electrode which removes at least one electron from the inert gas, and wherein the electrode and the surface are devoid of an electric arc between each other.

14. The method of claim 13, wherein the ionizing of the inert gas comprises ionizing the inert gas with a reverse transfer arc welding torch.

15. The method of claim 13, wherein the coating is a dense vertically cracked thermal barrier coating.

16. A method of improving strain tolerance and cyclic spallation life of a protective coating on a substrate comprising:

applying a bond coating to the substrate, the bond coating having a first surface roughness of less than about 60 microinches Ra;

ionizing an inert gas which flows into the surface of the bond coating so as to impart a second surface roughness to the bond coating of about 75 microinches Ra to about 750 microinches Ra, wherein the inert gas is ionized and caused to flow into the surface of the bond coating by a reverse polarity current supplied to an electrode which removes at least one electron from the inert gas, and wherein the electrode and the bond coating are devoid of an electric arc between each other; and applying a top coating to the bond coating by using air plasma spray.

17. The method of claim 16, wherein the ionizing of the inert gas comprises ionizing the inert gas using a reverse transfer arc welding torch.

* * * * *